United States Patent [19]

Loria et al.

[11] 4,304,183

[45] Dec. 8, 1981

[54] LATENT IMAGE-MULTIPLE COPY PROCESS

[75] Inventors: Adrian M. Loria, Wilmette; John L. Gilson, Morton Grove, both of Ill.

[73] Assignee: A. B. Dick Company, Niles, Ill.

[21] Appl. No.: 126,902

[22] Filed: Mar. 3, 1980

Related U.S. Application Data

[63] Continuation of Ser. No. 919,090, Jun. 26, 1978, abandoned.

[51] Int. Cl.[3] ..... B41M 5/04

[52] U.S. Cl. ..... 101/472; 101/119; 101/129; 101/132.5; 283/6; 428/199

[58] Field of Search ..... 101/119, 129, 472; 428/199; 283/6, 8 B

[56] References Cited

U.S. PATENT DOCUMENTS

| | | | |
|---|---|---|---|
| 1,579,439 | 4/1926 | Daus | 101/132 |
| 1,939,089 | 12/1933 | Tauschek | 101/132.5 |
| 2,086,011 | 7/1937 | Whitmore | 101/472 |
| 2,180,135 | 11/1939 | Bartholomew | 101/132.5 |
| 2,798,427 | 7/1957 | Klimkowski | 101/472 |
| 3,181,462 | 5/1965 | Newman | 101/472 |
| 3,593,659 | 7/1971 | Brackett | 101/143 |
| 3,690,252 | 9/1972 | Sokolov | 101/147 |
| 3,874,895 | 4/1975 | Hayashi | 428/199 |
| 4,051,283 | 9/1977 | Thomas | 428/199 |
| 4,097,637 | 6/1978 | Loria et al. | 428/914 |

*Primary Examiner*—Clyde I. Coughenour

*Attorney, Agent, or Firm*—McDougall, Hersh & Scott

[57] ABSTRACT

A latent image-multiple copy process wherein use is made of a stencil in which stencil openings are formed to correspond to the latent image and base sheets in combination therewith, containing an invisible, soluble, color forming component, whereby when the color forming component is depleted from the base sheet in the area underlying the stencil openings, the base sheet can be replaced for the production of additional copies without the need to provide for a new stencil.

3 Claims, 3 Drawing Figures

LATENT IMAGE-MULTIPLE COPY PROCESS

This is a continuation of application Ser. No. 919,090, filed June 26, 1978 now abandoned.

This invention relates to multiple copy reproduction of concealed images which are capable of subsequent visual development and relates more particularly to a method and means for practice of same.

In the co-pending application Ser. No. 671,137 filed Mar. 29, 1976 and entitled LATENT IMAGING MASTER, description is made of a master formed of a base sheet containing a water and/or alcohol soluble invisible color forming component having plural coatings on the surface thereof which are capable of electronic stencilization, whereby, when the image master is mounted on a duplicating machine for engagement by copy sheets wet with a water and/or alcohol fluid, some of the water and/or alcohol soluble invisible color forming components are leached through the stencil openings for transfer to the copy sheets to form an invisible latent image thereon. Instead, in a conventional stencil duplicating system, the image master can be wet with water and/or alcohol fluid whereby the soluble, invisible, color forming component is leached from the master for transfer on the copy sheets brought into contact therewith.

It has been found that the alcohol and/or water soluble, invisible, color forming component of the base sheet becomes depleted from the stenciled areas after a relatively small number of copies have been produced. As a result, the prepared master is no longer capable of use and a new master must be prepared if, and when, additional copies are desired. Thus, certain limitations are bred into a master of the type described whereby its use is restricted to the production of a relatively small number of copies (250–350).

It is an object of this invention to produce and to provide a method of producing a large number of copies of invisible images from a single image master and it is a related object to provide an assembly for use in the practice of same.

These and other objects and advantages of this invention will hereinafter appear and for purposes of illustration, but not of limitation, an embodiment of the invention is shown in the accompanying drawing in which.

Figure 1:
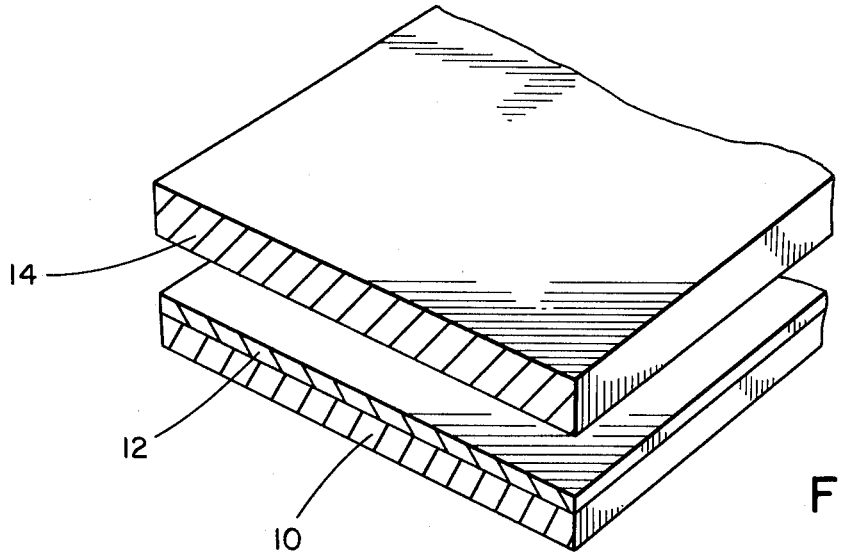
FIG. 1 is a perspective view in section of the elements of a stencil sheet assembly embodying the features of this invention with the elements separated one from the other in their relative positions in the assembly.
Figure 2:
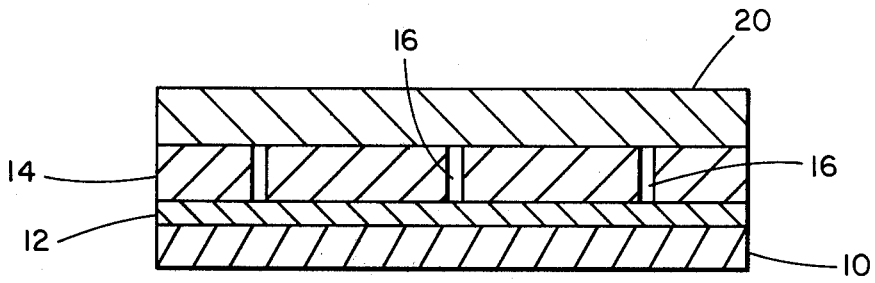
FIG. 2 is a sectional view of the stencil sheet assembly of FIG. 1 showing a copy sheet in surface contact therewith for transfer to form the latent image on the copy sheet.

In accordance with the practice of this invention the water and/or alcohol soluble invisible color forming component is incorporated in a base sheet as an element separate and apart from a stencil. Stencilization of the stencil can be achieved with the base sheet in surface contact therewith but, in the preferred practice of this invention, stencilization of the stencilizable element is carried out separate and apart from the base sheet to form the stencil openings therein corresponding to the latent image desired to be reproduced on the copy sheets. Thereafter, the base sheet and the stencilized element are positioned with the base sheet underlying the stencilized element in a duplicating machine for the production of copies.

In an offset machine, the ink fountain is provided with a fluid of water and/or alcohol which is adapted to flow through the stencil openings to leach the invisible, color forming component for passage through the stencilized openings for transfer via an offset blanket to copy sheets brought into contact therewith. Instead, use can be made of the stencilized assembly to produce copies by a conventional spirit duplicating process, as by mounting the assembly on the drum of a spirit duplicating machine whereby copies are produced as copy sheets, wet with a water and/or alcohol fluid, and brought into surface contact with the side of the stencilized element opposite the base sheet. In operation, water and/or alcohol on the surface of the copy sheets penetrate the stencil openings and leach some of the water and/or alcohol soluble invisible material in the portions of the base sheet underlying the stencil openings for transfer to the surfaces of the copy sheets. Those skilled in the art will appreciate that the stencil must be mounted differently, that is "right reading" on an offset machine using a blanket and "reverse reading" on a direct lithography or spirit duplicating machine.

Thus, a latent image is provided on the copy sheets in which all, or selected portions thereof, can subsequently be treated with a component that reacts with the invisible, color forming component of the latent image for visual development.

When the amount of invisible water and/or alcohol soluble, color forming component has been depleted from the portion underlying the stencil openings, instead of discarding the entire assembly and preparing a new assembly for the production of additional copies, in accordance with the practice of this invention, it is only necessary to separate the base sheet from the stencilized element to replace the spent base sheet with another without the need to repeat the process of stencilization of a new stencilizable element. Thus any number of additional copies can be produced merely by replacement of the base sheet to renew the amount of invisible water and/or alcohol color forming composition underlying the stencil openings for transfer through the stencil openings to the copy sheets.

The following examples are given by way of illustration but not by way of limitation:

EXAMPLE 1

Preparation of Base Sheet

The base sheet 10 is coated or impregnated with a composition which contains, as an essential ingredient, a water and/or alcohol soluble invisible color forming component to be leached for transfer from the portions underlying the stencil openings to the copy sheets to form latent images thereon.

The following are representative of such water and/or alcohol soluble invisible color forming components and the corresponding reactants adapted for development of visible image reaction therewith in the copy sheets:

| Colorless Component | Color Reactant (F) |
|---|---|
| 1. Citric Acid | 1. Leuco Dye CP-1 (Allied Chemical) |
| 2. Citric Acid | 2. Heat |

-continued

| Colorless Component | Color Reactant (F) |
|---|---|
| 3. Oxchek ® H (Hilton-Davis) | 3. Sodium Hypochlorite |
| 4. Phenolphthalein (retreatable) | 4. Alkali (temporary) |
| 5. Gallic Acid | 5. Ferric Chloride |
| 6. Dimethylglyoxime | 6. Nickel Acetate |
| 7. Cupric Chloride | 7. Dithiooxamide |
| 8. Cupric Chloride | 8. Hematoxylin |
| 9. Cupric Chloride/(starch) | 9. Potassium Iodide |
| 10. Potassium Ferricyanide | 10. Iron Salts |
| 11. Cobaltous Chloride | 11. Heat |
| 12. Ferric Sulphate | 12. Tannic Acid |
| 13. Uranine | 13. Ultra-violet Light |
| 14. Uranyl Nitrate | 14. Ultra-violet Light |
| 15. Cupric Sulphate | 15. Potassium Iodide |

Instead of making use of paper as the substrate 10 onto which the invisible color forming composition is applied as a coating 12, the base sheet can be selected of blotter stock, foam, fiber felts, cloth or absorbant paper, saturated, impregnated or coated with the invisible, color forming composition and then sheeted after drying to form the base sheet assembly. Whether applied by coating, impregnation or sheets, it is desirable to incorporate an amount of alcohol and/or water soluble, invisible, colorless color forming component sufficient to produce at least 250 to 350 copies and preferably up to 500 copies. For this purpose, such color forming component is incorporated to form a part of the base sheet in an amount which may range from 2.0 to 4.0 grams per square foot and preferably 2.5 to 3.3 grams per square foot.

EXAMPLE 2

Composition 21.5 parts by weight colorless component from the above table 3.5 parts by weight Natrosol 250LR (Hercules Chemical Co.)

54.0 parts by weight deionized water 21.0 parts by weight ethyl alcohol.

The colorless component and binder are dispersed and/or dissolved in the water and alcohol to provide a coating composition which is applied to the substrate 10 in an amount to provide a dry coating weight of 20–25#/3000 sq. ft. The composition can be applied by conventional coating techniques, such as flow coating, roller coating, brush coating and the like, drying by passage through an air drying oven heated to a temperature of 150°–350° F. for drying.

Instead of making use of Hercules Natrosol 250LR as the binder, use can be made of other water soluble or water dispersible high molecular weight polymeric materials such as highly hydrolyzed polyvinyl acetate, carboxymethyl cellulose, methyl cellulose, starch, casein and the like. The binder component functions to anchor the base coating 12 to the substrate 10. For this purpose, the concentration of the binder can range from 1 part by weight to 30 parts by weight per 100 parts by weight of the colorless color forming component, and preferably 1 to 10 parts by weight per 100 parts by weight of the colorless color forming component.

As the stencilizable element 14, use can be made of a conventional electronic stencil which may be stencilized as described in the aforementioned co-pending application, or use can be made of conventional stencil sheet assemblies, such as a mechanical stencil in which the stencil openings are formed by impact or in response to pressure for displacement of the stencil coating to form stencil openings through which the fluid can pass, or use can be made of heat or chemical stencils in which the desired stencil openings are formed in response to a heat pattern or the like.

When it is desired to transmit the latent image to copy sheets 20, the stencil 14 with the base sheet underlying the stencil is mounted on the drum of an offset duplicator or on the drum of a spirit duplicator. In the offset duplicator, the water and/or alcohol is supplied by the fountain train to the master surface with the ink train disengaged.

Figure 3:
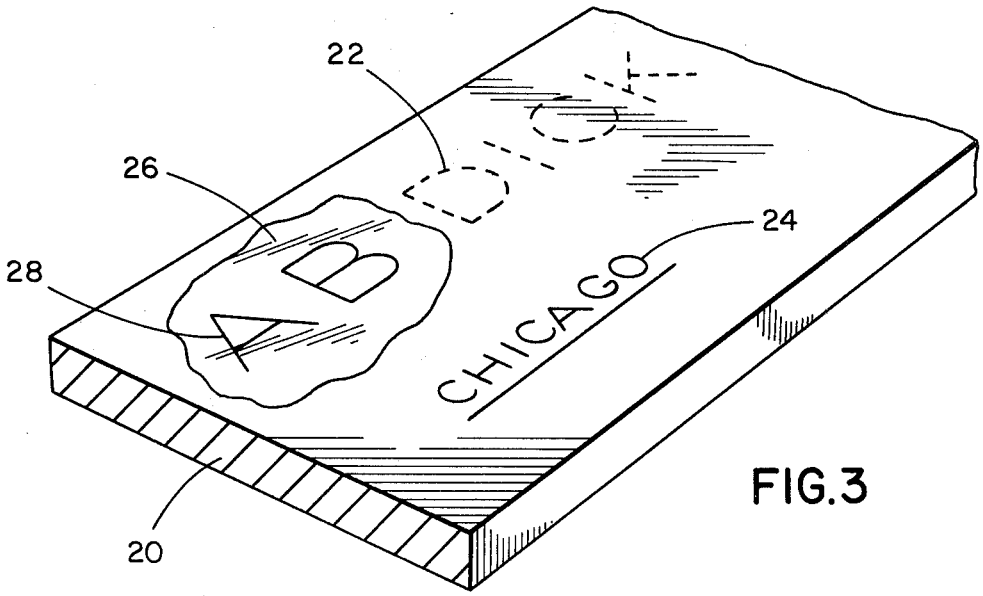
FIG. 3 is a perspective view of the copy sheet after visual development of the letters AB but before visual development of the remainder of the invisible latent image.

In a spirit duplicating process, when the copy sheet, wetted with the aqueous or spirit fluid, is brought into contact with the surface of the stencil sheet 14 having the stencilized openings 16, colorless component is dissolved by the fluid and leached from the base sheet through the stencil openings to the copy sheet to form the latent image 22 thereon. The copy sheet 20 may contain visible portions 24 in registry with the latent image portions, as illustrated in FIG. 3.

The invisible latent image 22 can be rendered visible by treatment with the appropriate "color reactant" 26 which reacts with the invisible color forming component for development of color to reveal the treated portions of the latent image.

The developer may be in the form of a liquid dispersion, solution, or emulsion, which can be applied to the latent image. Instead, it can be incorporated into a solid, as in a crayon, or the reactant can be transmitted to the latent image in the form of a vapor generated by heat or the like. The latent image is thus developed into a permanent or temporary visual image 28, as illustrated in FIG. 3. Instead, the invisible latent image can be formed of a component that can be made visible by color development in response to activation from an energy source, such as ultra-violet light and the like. In such instance, the combination for reaction with a developer component would be unnecessary.

It will be apparent from the foregoing that we have provided a simple and more efficient assembly and method for the preparation of multiple copies containing colorless latent images which can subsequently be developed by exposure of materials in the latent image with a developer that can be applied in the form of a liquid, solid, vapor or an energy source to form a visible image. Such copy sheets with latent invisible images in registry with visible images find wide usage as a teaching, instructional, or examination material, adapted for use in the educational or information field.

It will be understood that changes may be made in the details of construction, formulation, arrangement and operation, without departing from the spirit of the invention, especially as defined in the following claims.

We claim:

1. A multiple copy process for producing multiple copies containing a latent, invisible image capable of visual development in the copy sheets comprising providing a self supporting stencil having stencil openings corresponding to the latent image sought to be produced on the copy sheets, providing a separate self supporting base sheet containing an invisible, water and/or alcohol soluble color forming component, mounting the stencil in a duplicating machine with one side of the stencil in direct contact with the base sheet containing the invisible, water and/or alcohol soluble, color forming component, wetting the other side of the stencil with a fluid of water and/or alcohol whereby said fluid passes through the stencil openings into engagement with the base sheet to leach some of the invisible water and/or alcohol color forming component from the base sheet portions underlying the stencil openings for passage back through the stencil openings, whereby only the portions of the base sheet underlying the stencil openings are wet and whereby only the portions of the water and alcohol soluble, color forming component is wet for passage through the stencil openings, and transferring said leached, invisible, water and/or alcohol soluble color forming component from the stencil openings to copy sheets to form a latent image in the copy sheets corresponding to the stencil openings, replacing the stencil with another in which the stencil openings differ materially from the stencil openings of the previous stencil to enable continued use of the base sheet in the production of copies with multiple stencils, and replacing the base sheet with another when the invisible water and/or alcohol soluble color forming component has become depleted in the base sheet portions underlying the stencil openings.

2. A process as claimed in claim 1 in which in a spirit duplicating process the fluid is applied onto the copy sheets followed by bringing the copy sheets into contact with the surface of the stencil opposite the surface engaged by the base sheet whereby invisible color forming component is leached from the base sheet through the stencil openings for transfer onto the surface of the copy sheet.

3. A process as claimed in claim 1 in which, in an offset duplicating process, the fluid is supplied by the aqueous train of the offset duplicator, and the invisible water and/or alcohol soluble color forming component is leached from the base sheet through the stencil openings onto an offset blanket, and passing the copy sheets in contact with the offset blanket for transfer of the imaging material from the offset blanket to the copy sheets.

* * * * *